United States Patent [19]

Sagawa et al.

[11] Patent Number: 4,715,339

[45] Date of Patent: Dec. 29, 1987

[54] GOVERNOR FOR INTERNAL COMBUSTION ENGINE

[75] Inventors: Ryuichi Sagawa; Osamu Nagata; Hajime Yamada, all of Kobe, Japan

[73] Assignee: Kawasaki Jukogyo Kabushiki Kaisha, Japan

[21] Appl. No.: 769,891

[22] Filed: Aug. 27, 1985

[30] Foreign Application Priority Data

Sep. 1, 1984 [JP] Japan ..... 59-183521
Sep. 14, 1984 [JP] Japan ..... 59-193502

[51] Int. Cl.[4] ..... F02M 39/00
[52] U.S. Cl. ..... 123/357; 123/494
[58] Field of Search ..... 123/357, 358, 359, 500, 123/501, 419, 494, 436; 73/119 A; 123/352

[56] References Cited

U.S. PATENT DOCUMENTS

| | | | |
|---|---|---|---|
| 3,718,123 | 2/1973 | Ecrert | 123/357 |
| 3,722,485 | 3/1973 | Ohanti | 123/352 |
| 4,047,507 | 9/1977 | Noguchi | 123/357 |
| 4,051,818 | 10/1977 | Völkens | 123/494 |
| 4,323,042 | 4/1982 | Woodhouse | 123/419 |
| 4,357,662 | 11/1982 | Schira | 123/419 |
| 4,368,705 | 1/1983 | Stevenson | 123/357 |
| 4,372,266 | 2/1983 | Hiyama | 123/357 |
| 4,395,905 | 8/1983 | Fujimori | 123/357 |
| 4,492,196 | 1/1985 | Oshizawa | 123/357 |
| 4,502,437 | 3/1985 | Voss | 123/357 |
| 4,520,778 | 6/1985 | Nanjo | 123/352 |
| 4,577,718 | 3/1986 | Ueno | 123/352 |

FOREIGN PATENT DOCUMENTS 2072888 10/1981 United Kingdom .

OTHER PUBLICATIONS

43027 "Electric Control for Steam Turbine Application", Woodward Governor (Japan) Ltd. Jun. 1976.

*Primary Examiner*—Carl S. Miller
*Attorney, Agent, or Firm*—Leydig, Voit & Mayer

[57] ABSTRACT

A speed governor for engine includes a variation removing circuit responsive to an engine rotational speed signal indicative of the rotational speed of a diesel engine to remove a periodical variation component of the signal due to the pulsation of the output torque which the diesel engine generates, from the signal. The period of the variation to be removed by the variation removing circuit changes with the change of the rotational speed of the engine. The variation removing circuit may be formed of a sample-and-hold circuit or a variable characteristic filter of which the suppression frequency is variable.

10 Claims, 9 Drawing Figures

101
111
ENGINE SPEED PRESETTING DEVICE
L111a
+
112 SUBTRACTER
−
L112
113
CONTROL CALCULATION DEVICE
L113
FUEL SIGNAL
500
VARIATION REMOVING CIRCUIT
SPEED REGULATING UNIT
L105
ENGINE SPEED SIGNAL
100 FUEL INJECTION PUMP
102
DIESEL ENGINE
103
104 PROPELLER
105
ENGINE SPEED DETECTOR

GOVERNOR FOR INTERNAL COMBUSTION ENGINE

BACKGROUND OF THE INVENTION

This invention relates to governors for internal combustion engine and particularly to a governor for an engine having a fuel injection pump, such as a diesel engine.

The governor for a diesel engine adjusts the amount of injected fuel to be supplied to the diesel engine thereby controlling the rotational speed of engine.

Various types of governor are classified in accordance with their mechanism such as mechanical or electronic, but these governors perform the same function, namely, to supply sufficient fuel to the engine for a desired engine speed. To perform this function, the desired engine speed furnished to the governor and the actual speed of the diesel engine are compared to produce a speed deviation from which an amount of injected fuel necessary for the actual engine speed to follow the desired speed in accordance with a predetermined relationship is determined by control and calculation such as proportion, integration and differentiation. The fuel adjusting plunger, or rack of the fuel injection pump is then regulated by a signal indicative of this determined amount of injected fuel.

In the diesel engine, at each fuel injection timing an amount of fuel corresponding to the rack position of the fuel pump at the fuel injection timing at each cylinder is injected into corresponding cylinders and consumed to generate an output torque. However in a case where the fuel pump rack is operated by a governor, the control of engine speed is actually made by only the rack position of the fuel pump at the fuel injection timing at each cylinder. As a result, the variation of the rack position of the fuel pump between timings is not taken into consideration in the control of the engine speed.

Also, in the diesel engine, since the output torque is generated by the explosion of intermittently injected fuel, thus torque pulsates in accordance with the number of explosions. That is, when the diesel engine of Z cylinders rotates at a rotation speed N (rpm), the output torque pulsates at the period of $60/N \cdot Z$ (sec.) for a two-stroke engine, or at the period of $120/N \cdot Z$ (sec.) for a four-stroke engine. As a result, the engine speed pulsates at the same period.

The conventional governor of a diesel engine is not intended to control the periodical variation of engine speed due to the pulsation of the output torque generated by the diesel engine itself. Moreover, however the amount of injected fuel is adjusted by the governor, the output torque of the diesel engine cannot be prevented from pulsating.

In addition, even if the governor controls the rack of the fuel pump in response to the periodical change of engine speed due to the pulsation of the output torque, it repeats only useless operation of the rack because the operation at a time other than the fuel injection timing is useless.

Therefore, it is desired that the governor of diesel engine should not be affected by the periodical variation of engine speed due to the pulsation of the output torque generated from the diesel engine itself. In the conventional governor, however, any countermeasure effective against that problem is not made yet.

A governor may be proposed in which a mechanical or electrical low-pass filter for the engine-speed signal is provided so that the governor does not respond to the periodical speed variation due to the pulsation of the output torque generated from the diesel engine itself.

In such a governor, however, since the period of the engine-speed variation is changed in proportion to the rotational speed, the cut-off frequency of the low-pass filter must be decreased to remove the engine speed variation in the low engine speed range. Therefore, this governor arrangement suffers a deterioriation in its control ability at various engine speeds by the effect of phase lag in the low-pass filter, and as a result the control of the engine speed is apt to be unstable.

SUMMARY OF THE INVENTION

Accordingly, it is an object of this invention to provide a governor for an internal combustion engine capable of eliminating periodical variations of engine speed so that fuel injection control can be achieved to provide stable control of rotational speed.

To accomplish this objective a variation removing, over a wide range of engine speeds, circuit is provided for accurately removing the periodical variation of the detected signal of engine speed due to the pulsation of the output torque generated by the internal combustion engine itself.

According to one aspect of this invention, there is provided a governor for an internal combustion engine comprising engine speed detecting means for detecting the rotational speed of the engine and for producing an engine speed signal indicative of the engine speed, a variation removing circuit responsive to the engine speed signal from the detecting means for removing periodical variation components of the speed signal, engine speed presetting means for producing an engine speed setting signal indicative of a desired rotational speed of the engine, and means for calculating an amount of injected fuel to be supplied to the engine on the basis of the output signals from the variation removing circuit and from the engine speed presetting means and supplying a fuel signal indicative of the calculated amount of injected fuel to a fuel injection pump provided in the engine.

BRIEF DESCRIPTION OF THE DRAWINGS

The present invention will be apparent from the following detailed description taken in conjunction with the accompanying drawings, in which.

DESCRIPTION OF THE PREFERRED EMBODIMENTS

Figure 1:
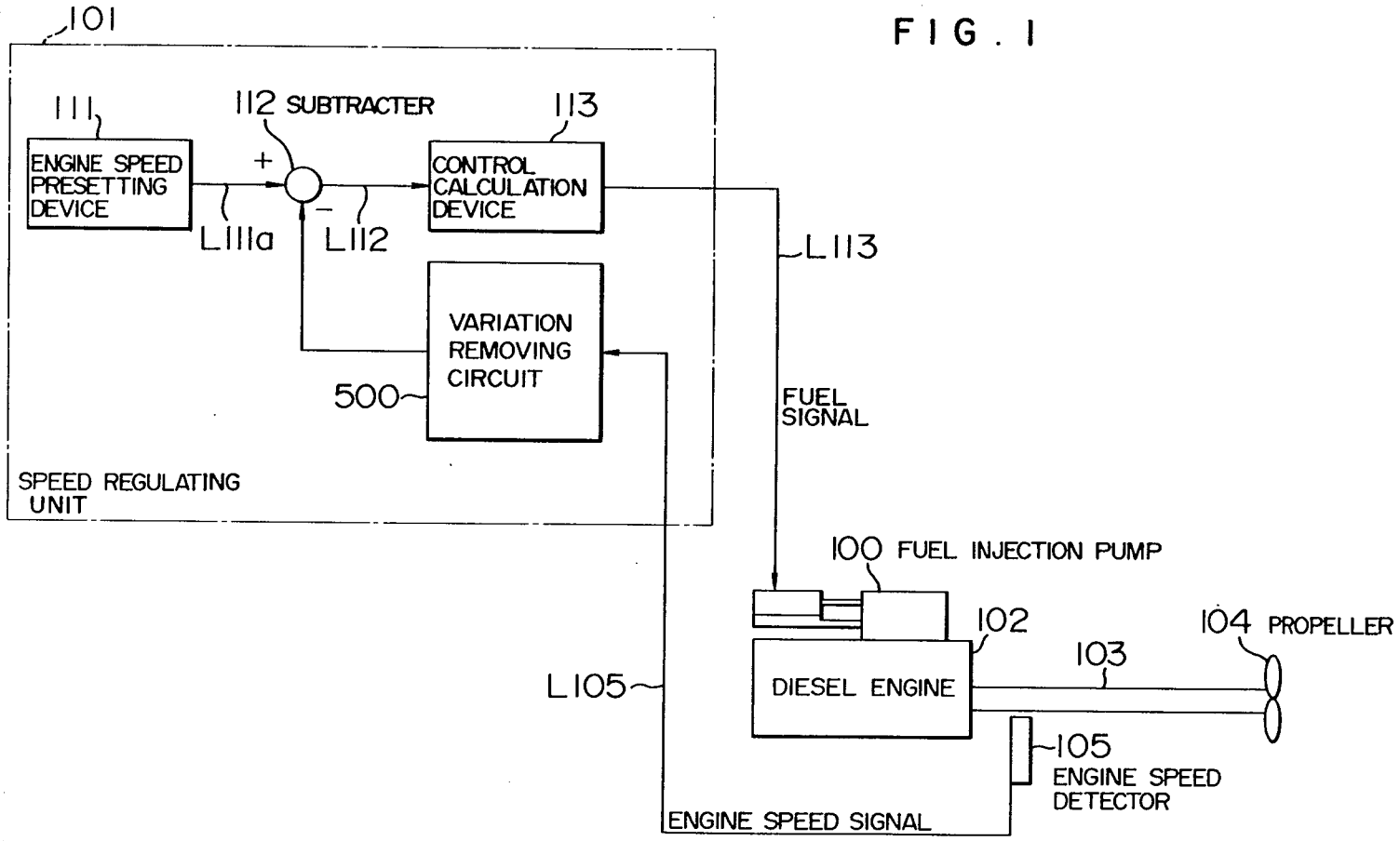
FIG. 1 shows the whole basic arrangement of the invention.

FIG. 1 shows the whole basic arrangement of a governor of the invention. Referring to FIG. 1, there are shown a speed regulating unit 101, a diesel engine 102, a fuel injection pump 100 of the diesel engine 102, a driving shaft 103 connected to the crank shaft (not shown) of the diesel engine 102, and a marine propeller mounted to the driving shaft 103.

At least an engine speed detector 105 is provided at the driving shaft 103, and thus an engine speed signal therefrom is supplied via a line L 105 to the speed regulating unit 101.

The speed regulating unit 101 determines an amount of injected fuel necessary for the engine to reach a desired rotational speed on the basis of an engine speed set signal from an engine speed presetting device 111 and the engine speed signal, and supplies a fuel signal indicative of the amount of injected fuel via line L 113 to the fuel injection pump 100, thereby controlling the position of the rack (not shown) for adjusting the amount of injected fuel within the fuel injection pump 100.

The speed regulating unit 101 includes the engine speed presetting device 111 for presetting the rotational speed of the diesel engine 102, a subtracter 112, a control calculation device 113 for calculating a necessary amount of fuel on the basis of the output from the subtractor 112 and producing an output signal corresponding to the amount of fuel, and a variation removing circuit 500 for removing the periodically varying component within the engine speed signal which the engine speed detector 105 produces, over a wide range of engine rotational speed. This variation removing circuit 500 features this invention. According to the governor of this invention, since the engine speed signal which the engine speed detector 105 generates is supplied through the variation removing circuit 500 to the subtracter 112, the control calculation device 113 is able to always calculate correct amount of injected fuel over a wide range of engine rotational speed. The fuel signal from the control calculation device 113 is fed via the line L 113 to the fuel injection pump 100 of the diesel engine 102.

Figure 2:
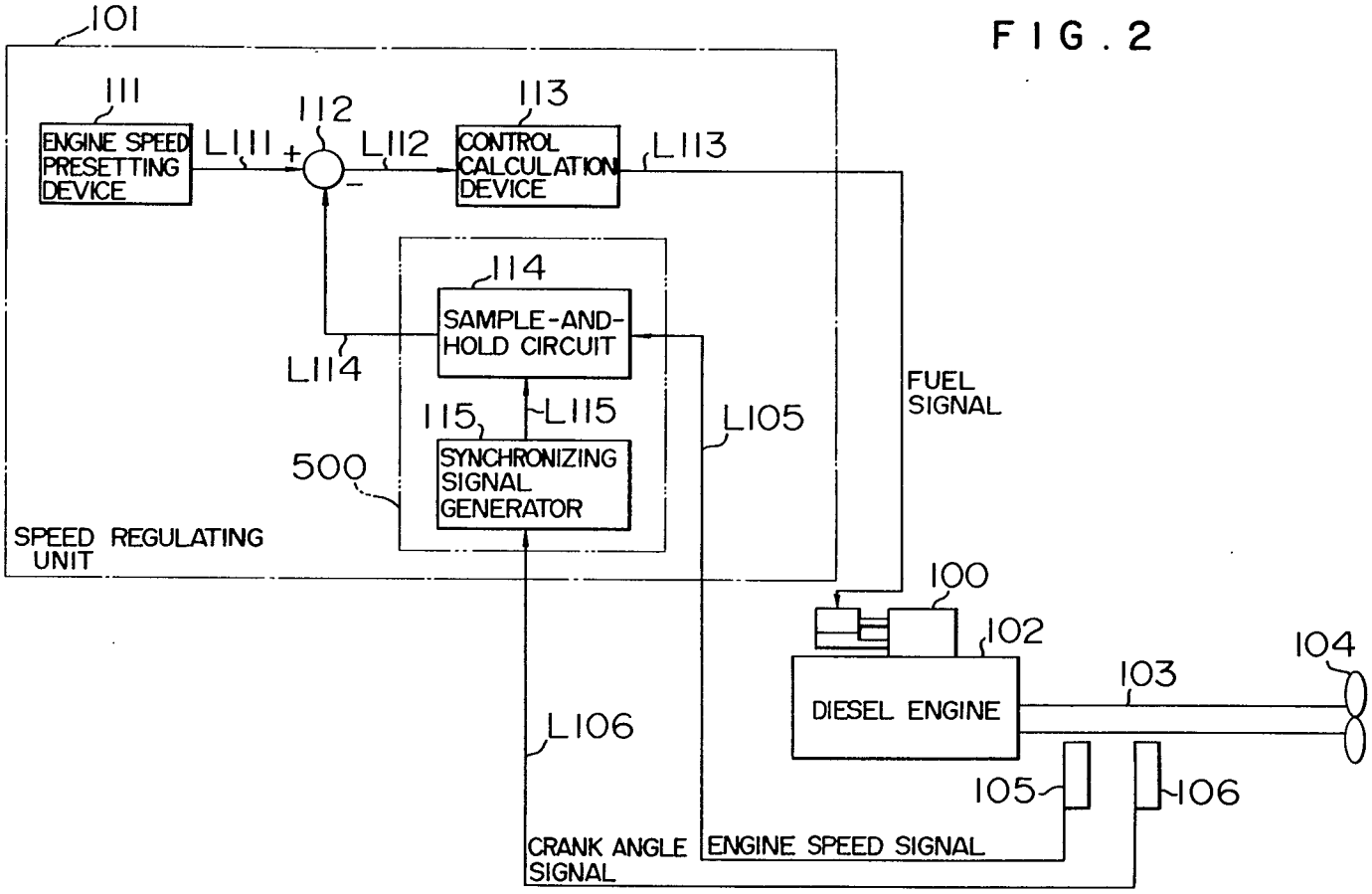
FIG. 2 shows the whole arrangement of a first embodiment of a governor of the invention.

An embodiment of this invention will hereinafter be described with reference to FIG. 2. FIG. 2 shows the whole arrangement of a first embodiment of this invention. In FIG. 2, like elements corresponding to those in FIG. 1 are identified by the same reference numerals. Referring to FIG. 2, there are shown the engine speed detector 105 and a crank angle detector 106 provided on the driving shaft 103. The engine speed signal and crank angle signal therefrom are supplied via the line L 105 and a line L 106 to the speed regulating unit 101.

The speed regulating unit 101 determines an amount of injected fuel necessary for the engine to reach a preset rotational speed on the basis of the engine speed set signal from the engine speed presetting device 111, the engine speed signal and the crank angle signal, and supplies the fuel signal through the line L 113 to the fuel pump 100, thereby controlling the position of the rack (not shown) of the fuel pump.

In FIG. 2, the variation removing circuit 500 comprises a sample-and-hold circuit 114 and a synchronizing signal generator 115. That is, the speed regulating unit 101 comprises the engine speed presetting device 111, the synchronizing signal generator 115, the sample-and-hold circuit 114, the subtractor 112 and the control calculation device 113. These elements function as follows.

The synchronizing signal generator 115 is responsive to the crank angle signal from the crank angle detector 106 to produce a timing signal at intervals of 360°/Z (Z is the number of cylinders) for crank angles, 0° to 360°. This timing signal is supplied through the line L 115 to the sample-and-hold circuit 114.

The sample-and-hold circuit 114 is supplied with the timing signal from the synchronizing signal generator 115 via the line L 115 and with the engine speed signal from the engine speed detector 105 via the line L 105. Thus, this sample-and-hold circuit samples the engine speed signal when the timing signal is received and holds the sampled rotational-speed signal until the next timing signal is received. This held rotational-speed signal is supplied through a line L 114 to the subtractor 112.

The subtracter 112 acts to calculate the difference between the engine speed preset signal from the engine speed presetting device 111 via the line L 111 and the rotational speed signal which is held in the sample-and-hold circuit 114 and supplied therefrom via the line L 114, and to supply the deviation signal via the line L 112 to the control calculation device 113.

The control calculation device 113 is responsive to the rotational-speed deviation signal fed via the line L 112 from the subtracter 112 to calculate a fuel signal by the control calculation such as proportion, integration and differentiation. This fuel signal is indicative of an amount of injected fuel to be fed to the diesel engine 102, and supplied via the line L 113 to the fuel injection pump 100 to control the rack (not shown) of the fuel injection pump 100.

Figure 3:
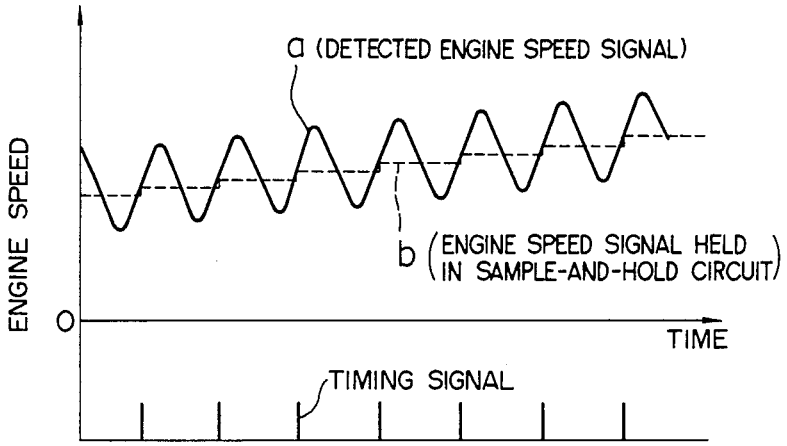
FIG. 3 shows waveforms of the detected engine speed signal a and the engine speed signal b held in the sample-and-hold circuit with respect to the timing signal.

The engine rotational speed of the diesel engine 102 is periodically changed due to the pulsation of the output torque which the diesel engine 102 itself generates, and therefore the engine speed signal detected by the engine speed detector 105 shows the periodic variation as indicated by a curve a in FIG. 3.

On the other hand, the sample-and-hold circuit 114 samples the engine speed signal in response to the sampling signal which is produced from the synchronizing signal generator 115 in synchronism with the variation period of the rotational speed, and holds and produces the sampled rotational speed signal until the next timing signal is received by the sample-and-hold circuit.

Therefore, the held and produced rotational speed signal from the sample-and-hold circuit 114 is as indicated by a stepped broken-line b in FIG. 3. That is, the periodic variation due to the pulsation of the output torque generated by the diesel engine 102 itself is removed from the detected engine speed signal, so that an averaged rotational speed signal is produced from the sample-and-hold circuit.

Thus, the subtracter 112 and the control calculation device 113 make calculation on the basis of the signal fed via the line L 114 from the sample-and-hold circuit 114, and thereby control only the averaged rotational speed without response to the variation of the rotational speed due to the pulsation of the output torque generated from the diesel engine 102 itself.

A second embodiment of this invention will be described with reference to FIGS. 4 and 5.

Figure 4:
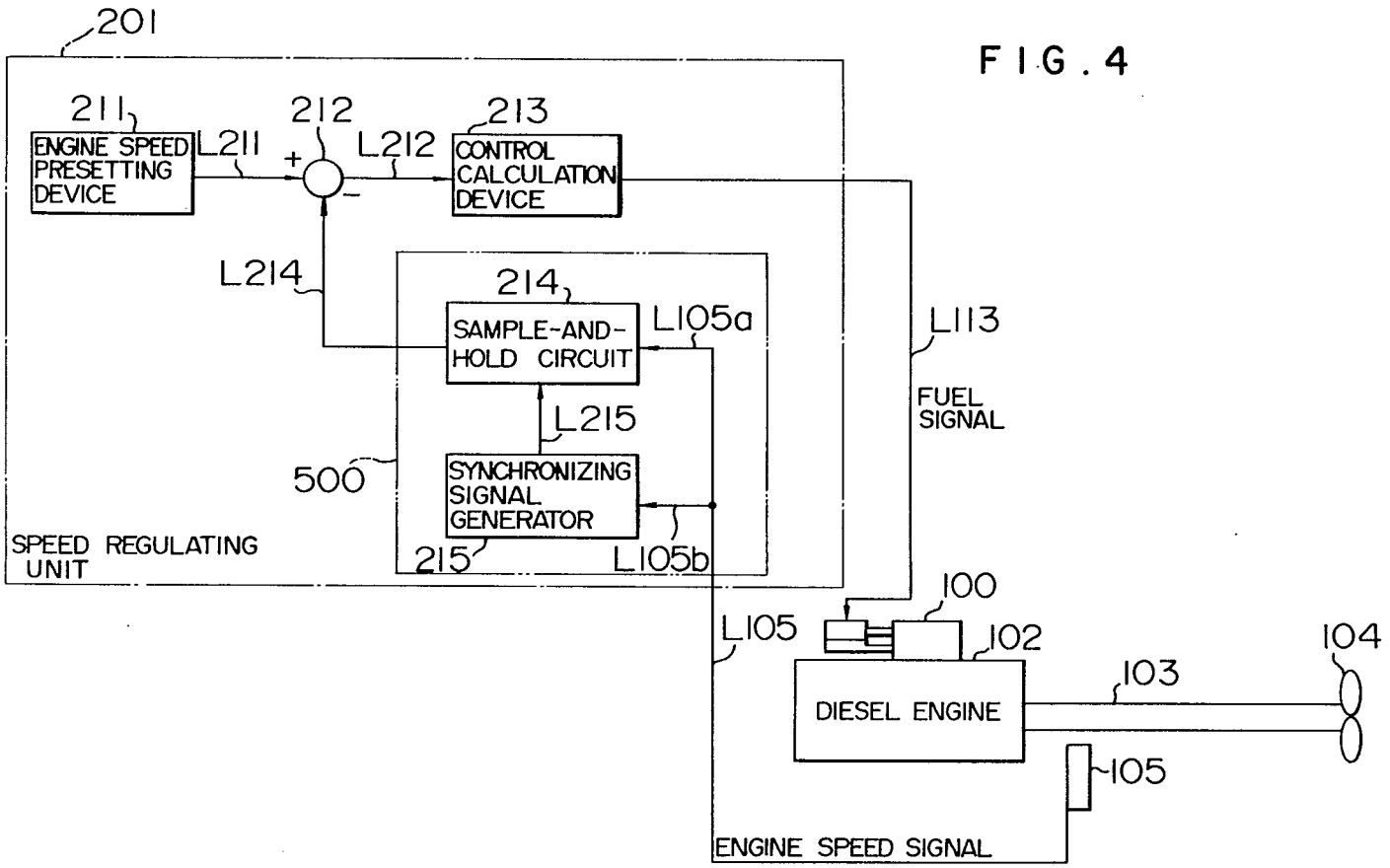
FIG. 4 shows the whole arrangement of a second embodiment of a governor of this invention.

In FIG. 4, like elements corresponding to those of FIG. 2 are identified by the same reference numerals.

The engine speed detector 105 is provided on the driving shaft 103, and this engine speed detector 105 produces a pulse signal at intervals of a constant rotational angle, or at every constant crank angle and supplies it via the line L 105.

As shown in FIG. 4, the variation removing circuit 500 comprises a sample-and-hold circuit 214 and a synchronizing signal generator 215. In other words, a speed regulating unit 201 comprises an engine speed presetting device 211, the synchronizing signal generator 215, the sample-and-hold circuit 214, a subtracter 212, and an control calculation device 213. These elements function as follows.

The sunchronizing signal generator 215 the construction of which will be described later is responsive to the pulse signal from the engine speed detector 105 via a line L **150*b* to produce a timing signal and supply it via a line L 215. In the speed regulating unit 201**, the timing signal is formed from the engine speed signal.

The sample-and-hold circuit 214 the construction of which will be described later receives the pulse signal from the engine speed detector 105 via the line L **105*a* and supplied a digitized engine speed signal via a line L 214**.

The subtracter 212 calculates the difference between a engine speed set signal fed via a line L 211 from the engine speed presetting device 211 and the digitized engine speed signal fed via the line L 214 from the sampleand-hold circuit 214 and supplies it via a line L 212 as an engine rotational speed deviation signal.

The control calculation device 213 is supplied with the engine rotational speed deviation signal from the subtracter 212 via the line L 212, and determines an amount of injected fuel to be fed to the diesel engine 102 by the control calculation such as proportion, integration and differentiation. The fuel signal is supplied via the line L 113 to the fuel injection pump 100, controlling the rack position (not shown) of the fuel injection pump 100.

Figure 5:
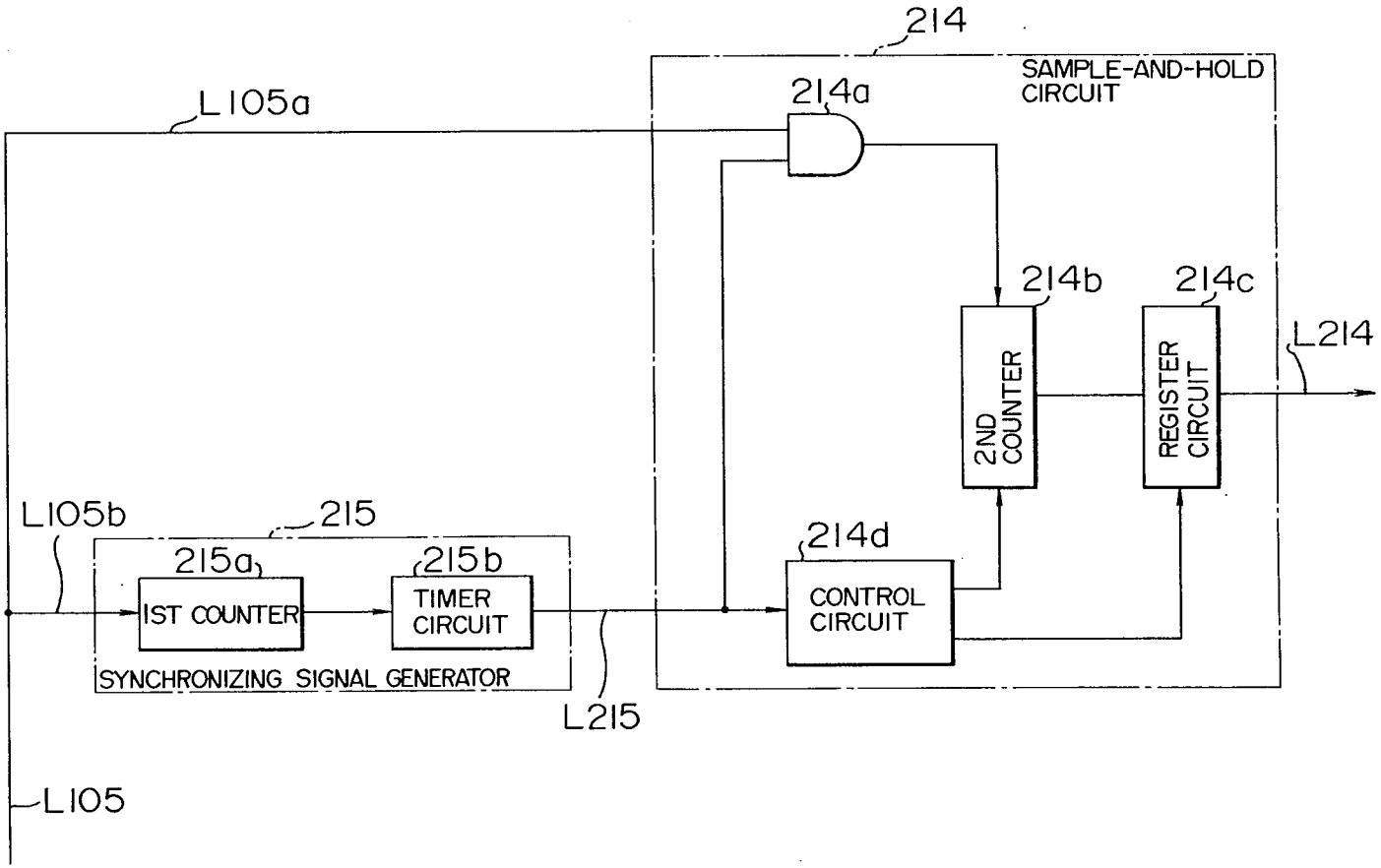
FIG. 5 is a block diagram of the synchronizing circuit and the sample-and-hold circuit in the governor shown in FIG. 4.

The sunchronizing signal generator 215 as shown in FIG. 5 comprises a first counter **215*a* for integrating the pulse signal fed via the line 105*b* and a timer circuit 215*b* which is responsive to an overflow signal from the first counter 215*a*** to produce a pulse signal of a constant duration $\Delta T$ as a timing signal.

The first counter **215*a* is designed to produce for the synchronization with the timing signal the overflow signal at the pulse count $[360°/Z/\Delta\theta]$ corresponding to the crank angle 316°/Z (Z is the number of cylinders) plus 1, where $\Delta\theta$ is the crank angle corresponding to the pulse signal from the engine speed detector 105** and the bracket [X] indicates the maximum integer not exceeding a number X.

The sample-and-hold circuit 214 comprises an AND gate **214*a* for controlling the pulse signal from the engine speed detector 105 via the line L 105*a* to pass therethrough in response to the timing signal of constant time duration $\Delta T$, a second counter 214*b* for integrating the pulse signal from the AND gate 214*a*, a register circuit 214*c* for holding the integrated digital signal from the second counter 214*b*, and a control circuit 214*d* for generating a transfer signal to the register circuit 214*c* and a reset signal to the second counter 214*b* in response to the timing signal of a constant width fed via the line L 215 from the timer circuit 215*b***.

Thus, the synchronizing signal generating circuit 215 supplies the timing signal of a constant duration $\Delta T$ via the line L 215 to the sample-and-hold circuit 214 at intervals of crank angle, 360°/Z. The AND gate **214*a* of the sample-and-hold circuit 214 opens while this timing signal is being supplied thereto, permitting the engine speed signal to pass therethrough, and the second counter 214*b*** thereof integrates the engine spaced signal.

When the timing signal is stopped from being supplied after the lapse of the constant time $\Delta T$, the AND gate 214 closes and the second counter **214*b* stops its integrating operation. The integrated value, count of the second counter 214*b* is the number of pulses occuring during the constant time $\Delta T$, or the average rotationalspeed of engine in the time $\Delta T$. Also, as soon as the timing signal is stopped, the control circuit 214*d* supplies the transfer signal to the register circuit 214*c* and the integrated value from the second counter 214*b* is transferred to the register circuit 214*c*. That is, the timing signal in the speed regulating unit 201 shown in FIG. 4 is the gate signal for controlling the AND gate 214**.

Then, the control circuit **214*d* supplies the reset signal to the second counter 214*b***, thus resetting it.

As a result, the register circuit **214*c* holds the rotational speed signal of engine integrated and digitized in the second counter 214*b***. This engine speed signal is updated at each timing signal.

Moreover, in this embodiment, since the timing signal is synchronized with the period of the variation of engine speed due to the pulsation of the output torque of the diesel engine 102, the digital engine speed signal held in the register circuit **214*c* includes no periodical variation of engine speed due to the output torque of the diesel engine 102**.

The governor according to this invention is not limited to the second embodiment, but can be constructed to include various types of synchronizing signal generator and sample-and-hold circuit depending on the type of the engine speed detector to be used.

Third and fourth embodiments of this invention will be described with reference to FIGS. 6 and 7.

Figure 6:
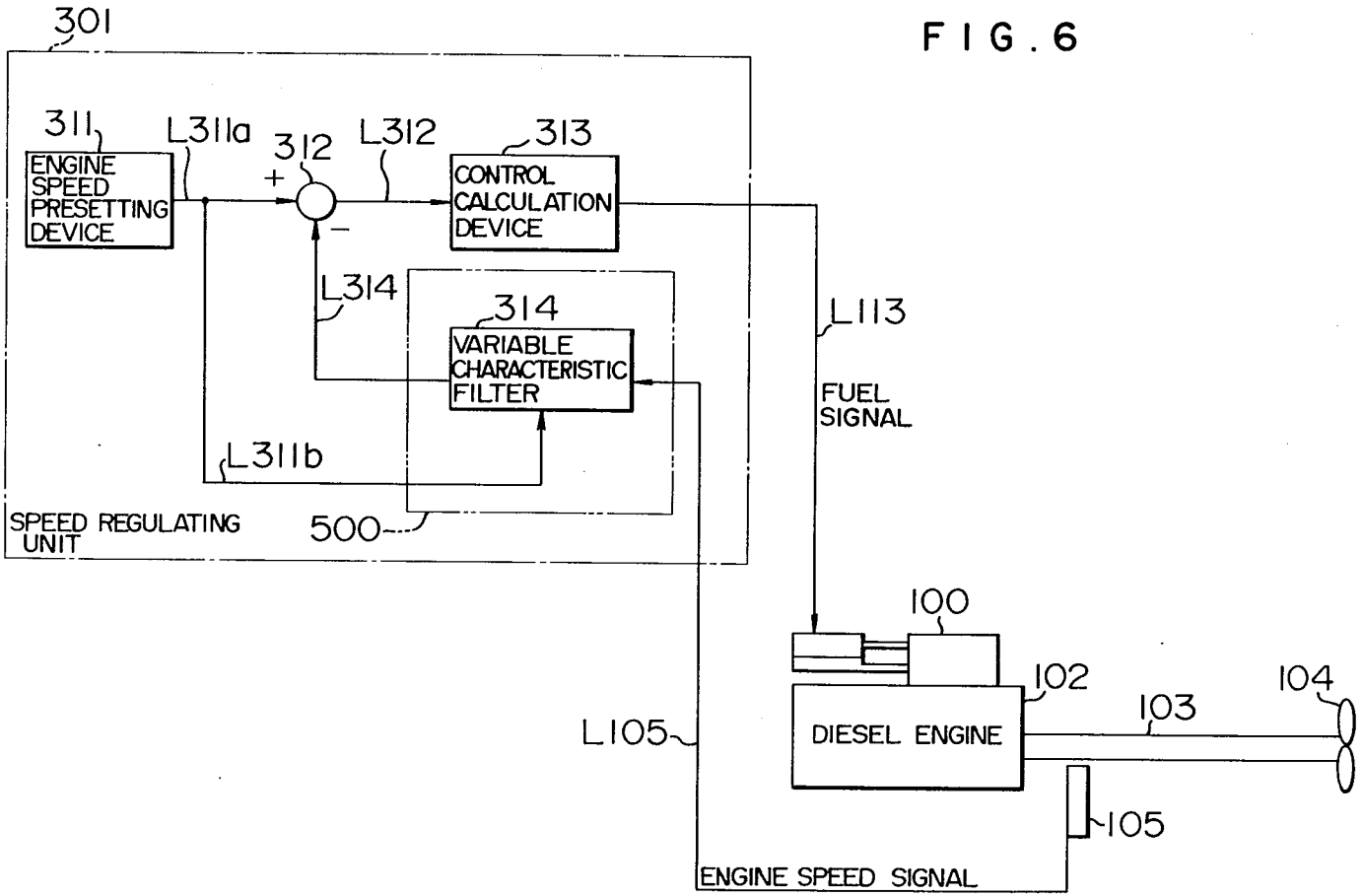
FIG. 6 shows the whole arrangement of a third embodiment of a governor of this invention.

FIG. 6 shows the whole arrangement of a third embodiment of this invention. In FIG. 6, like elements corresponding to those of FIGS. 1, 2 or 4 are identified by the same reference numerals.

The engine speed detector 105 is provided on the driving shaft 103, and the engine speed signal is fed therefrom via the line L 105 to a speed regulating unit 301.

The speed regulating unit 301 determines an amount of injected fuel necessary for the engine to reach a preset rotational speed on the basis of a engine speed set signal from a engine speed presetting device 311 and the engine speed signal, and supplies the fuel signal via the line L 113 to the fuel injection pump 100, thereby controlling the rack position (not shown) of the fuel injection pump 100.

In FIG. 6, the variation removing circuit 500 is formed of a variable characteristic filter 314. That is, the speed regulating unit 301 comprises the engine speed presetting device 311 for presetting a engine speed of the diesel engine 102, the variable characteristic filter 314, a subtracter 312, and a control calculation device 313. These elements are operated as follows.

The variable characteristic filter 314 receives the engine speed signal fed from the engine speed detector 105 via the line L 105, eliminates the variation of the rotational speed of engine due to the pulsation of the output torque of the diesel engine 102 and supplies a filtered engine speed signal corresponding to the average rotational speed, via a line L 314 to the subtracter 312.

The engine speed presetting device 311 supplies the engine speed set signal via a line L 311*a* to the subtracter 312.

The subtracter 312 receives the engine speed set signal from the engine speed presetting device 311 and the filtered engine speed signal from the variable characteristic filter 314, calculates the difference therebetween as a rotational-speed deviation signal and supplies it via a line L 312 to the control calculation device 313.

The control calculation device 313 receives the rotational-speed deviation signal from the subtracter 312, and produces a fuel signal necessary for the average rotational speed of the diesel engine 102 to follow the preset value from the engine speed presetting device 311, by the known control calculation such as proportion, integration and differentiation of the rotational speed deviation signal. This fuel signal is supplied via the line L 113 to the fuel injection pump 100, controlling the rack position (not shown) of the fuel injection pump 100 for injecting a necessary amount of fuel.

The variable characteristic filter 314 is a band-eliminating filter which receives the engine speed set signal fed from the engine speed presetting device 311 via the line L 311*b* and eliminates a signal component of a band including the engine speed variation frequency $f_c$ corresponding to this engine speed set signal.

In other words, the rotational speed variation frequency $f_c$ is selected to be $$f_c = N_s Z/60 \text{ (Hz)}$$

for two-stroke diesel engine, or to be $$F_c = N_s Z/120 \text{ (Hz)}$$

for four-stroke diesel engine. Thus, the elimination band of the variable characteristic filter 314 changes in accordance with the change of the engine speed set signal from the engine speed presetting device 311. Here, $N_s$ represents the set engine speed (rpm), and Z the number of cylinders.

Since the rotational speed of engine follows the rotational speed set by the engine speed presetting device 311, the engine speed varying component included in the engine speed signal can be eliminated by the variable characteristic filter corresponding to the speed variation frequency $f_c$ for the engine speed set signal.

Figure 7:
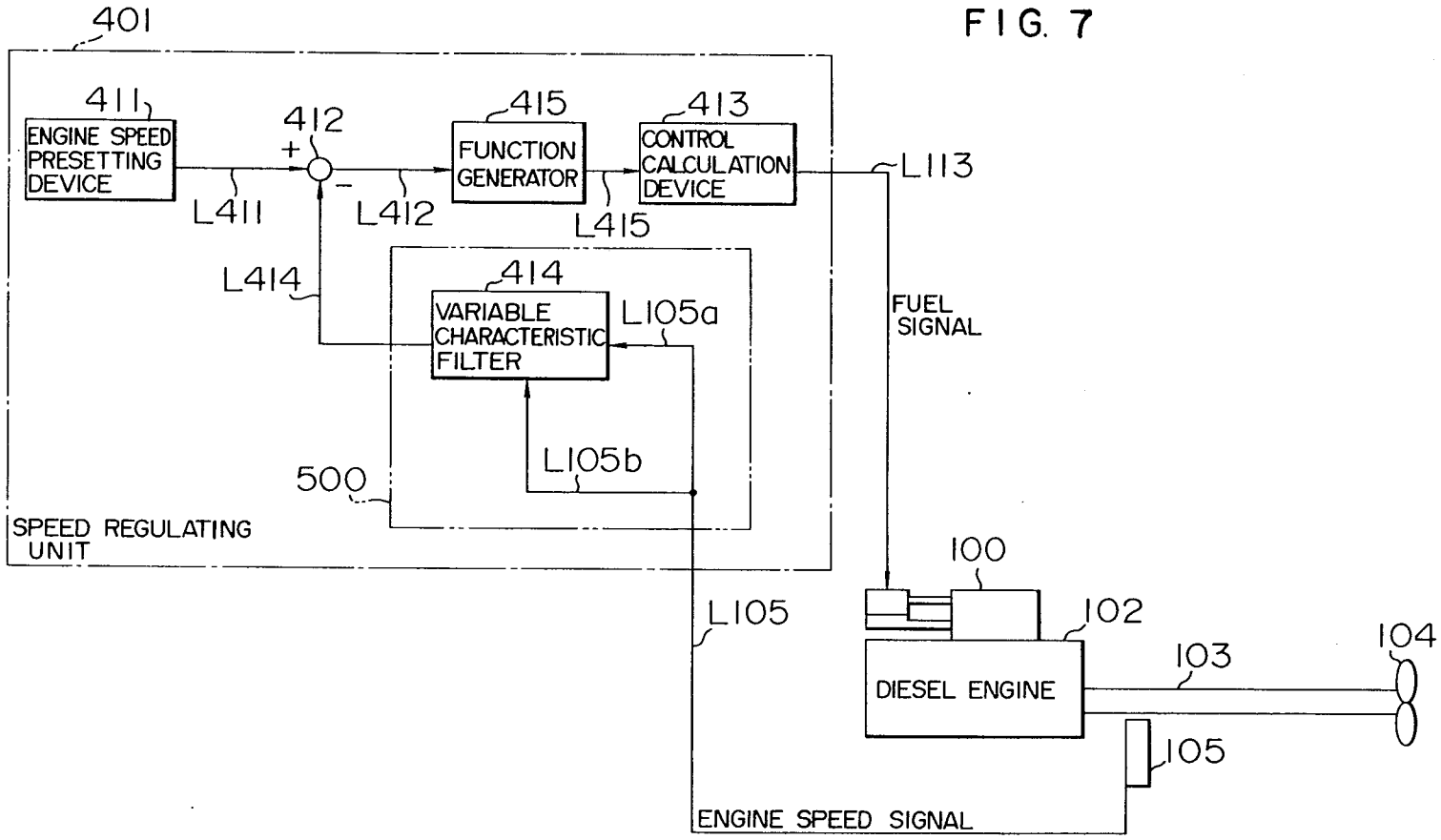
FIG. 7 shows the whole arrangement of a fourth embodiment of this invention.

FIG. 7 shows the whole arrangement of the fourth embodiment of this invention. In FIG. 7, like elements corresponding to those in FIGS. 1, 2, 4 or 6 are identified by the same reference numerals.

The engine speed detector 105 is provided on the driving shaft 103, and the engine speed signal is supplied via the line L 105 to a speed regulating unit 401.

The speed regulating unit 401 comprises an engine speed presetting device 411 for presetting the rotational speed of the diesel engine 102, a variable characteristic filter 414, a subtractor 412, a function generator 415, and a control calculation device 413. These elements are operated as follows.

The variable characteristic filter 414 receives the engine speed signal fed from the engine speed detector 105 via the line L 105, eliminates the variation of the engine speed due to the pulsation of the output torque of the diesel engine by means which will be described later, and supplies a filtered engine speed signal corresponding to the average engine speed to the subtracter 412 via a line L 414.

The engine speed presetting device 411 supplies the engine speed set signal to the subtracter 412 via a line L 411.

The subtracter 412 receives the engine speed set signal from the engine speed presetting device 411 and the filtered engine speed signal from the variable characteristic filter 414, and calculates the difference therebetween to produce an engine speed deviation signal. This engine speed deviation signal is supplied via a line L 412 to the function generator 415.

Figure 8:
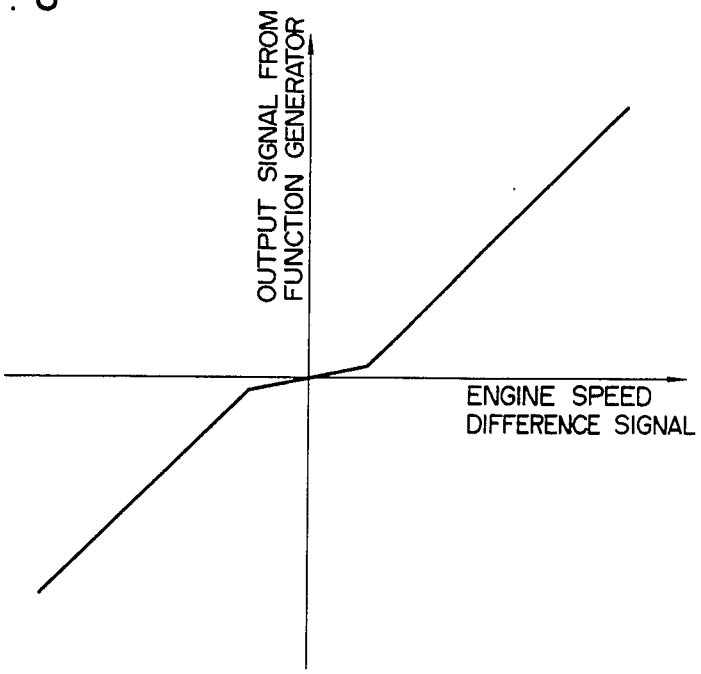
FIG. 8 is a graph of the characteristic of the function generator in the governor shown in FIG. 7.

The function generator 415 receives the engine speed deviation signal from the subtractor 412 adn supplies an output signal, for example as shown in FIG. 8, via a line L 415. That is, the function generator 415 provides a low gain for small engine speed deviation signal and a normal gain for larger engine speed deviation signal.

Therefore, for the variation amplitude of the periodical variation due to the pulsation of the output torque of the diesel engine itself, the function generator provides a low gain to reduce the amount of operation of the fuel pump, while for a large speed deviation due to the change of engine speed set value, great change of load and so on, the function generator shows such a response that it were not connected in the signal path, thus the engine speed being caused to follow the preset engine speed.

The control calculation device 413 produces a fuel signal for the amount of injected fuel necessary for the average engine speed of diesel engine 102 to follow the preset value from the engine speed presetting device 411 by the known control calculation such as proportion, integration and differentiation of the output signal from the function generator 415 via a line L 415. This fuel signal is supplied via the line L 113 to the fuel injection pump 100, controlling the rack position of the fuel injection pump 100.

Figure 9:
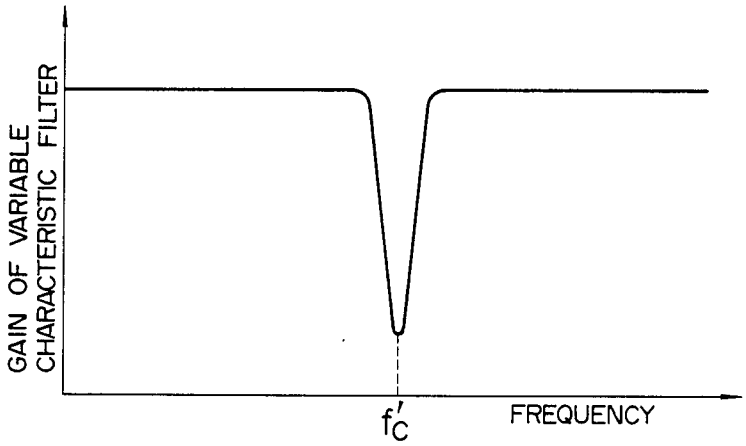
FIG. 9 is a graph showing the relation between the gain and frequency of the variable characteristic filter in the governor illustrated in FIG. 7.

The variable characteristic filter 414 in this embodiment is a band-elimination filter which receives the engine speed signal fed via the line L 105*b*, and eliminates the signal component of the band including at its center the speed variation period, $1/f_c$ assumed as shown in FIG. 9 on the basis of the previously given equation, this speed variation being caused by the pulsation of the output torque of the diesel engine.

Thus, the elimination band of the variable characteristic filter 414 is changed with the change of the average speed of the diesel engine.

The average engine speed necessary in the variable characteristic filter 414 may be the average of the engine speed in a predetermined time, the speed signal filtered out by another filter incorporated in the variable characteristic filter 414, or the filtered engine speed from the variable characteristic filter 414.

The governor for internal combustion engine according to this invention is not limited to the above first to fourth embodiments but can take various modifications and variations in accordance with the conditions in which the respective elements or devices are operated.

For example, although the pulsation of the output torque is great in the diesel engine, it also exists within cycle in the gasoline engine. Thus, it is obvious that this invention can be applied to the gasoline engine thereby making more accurate speed regulation control.

According to the governor of the invention, since the variation removing circuit is provided, the periodical variation of engine speed due to the output torque which the internal combusion engine itself generates can be removed and thus the average engine speed necessary for driving the load can be stably controlled. In addition, since the useless operation of the rack of the fuel pump can be removed, it is possible to reduce the mechanical damage and wear thereof.

Moreover, according to the third and fourth embodiments of this invention, since the speed variation frequency due to the pulsation of the output torque of the engine itself is assumed on the basis of a preset engine speed and the band including at its center the assumed frequency can be eliminated by the variable characteristic filter which forms the variation removing circuit, the governor is prevented from unnecessarily responding to the variation of engine speed, and the adverse effect of phase lag caused by the insertion of the low-pass filter can be minimized by removing the band matched with the operating condition of the engine by the variable characteristic filter.

Furthermore, it is possible to eliminate the engine speed variation not only due to the pulsation of the output torque of engine itself, but also due to the torsional vibration of the driving shaft which is caused by the relation between the pulsation of the output torque and the load.

We claim:

1. A governor for an internal combustion engine having a fuel pump comprising:

engine rotational speed detecting means for detecting a rotational speed of an engine and producing an engine rotational speed signal indicative of the engine rotational speed;

a variation removing circuit connected to receive the engine rotational speed signal from said detecting means and having means for removing from the engine rotational speed signal a periodical variation component due to pulsation of output torque generated by the engine itself prior to producing an averaged rotational speed signal and having a varying period corresponding to the variable rotational speed of the engine and a frequency $$fc = Ns \cdot Z/60 \text{ Hz}$$

for a two stroke engine and $$fc = Ns \cdot Z/120 \text{ Hz}$$

for a four stroke engine where

Ns = engine rpm

Z = number of cylinders;

engine rotational speed presetting means for generating an engine rotating speed setting signal indicative of a desired engine rotational speed; and means for calculating an amount of injected fuel to be supplied to the engine on the basis of the averaged rotational speed signal and speed setting signal from said variation removing circuit and said engine rotational speed presetting means, respectively, and for supplying a fuel signal indicative of the calculated amount of injected fuel to the injection pump for the engine.

2. A governor according to claim 1 further comprising crank angle detecting means for detecting crank angle position and producing a crank angle signal wherein said variation removing circuit includes:

a sample-and-hold circuit for sampling and holding the engine rotational speed signal from said engine rotational speed detecting means; and a synchronizing signal generator for generating a timing signal to control the operation of said sample-and-hold circuit on the basis of the crank signal from said crank angle detecting means.

3. A governor according to claim 1 wherein said variation removing circuit includes:

a sample-and-hold circuit for sampling and holding the engine rotational-speed signal from said engine rotational-speed detecting means; and a synchronizing signal generator for generating a timing signal to control the operation of said sample-and-hold circuit on the basis of the engine rotational speed signal from said engine rotational-speed detecting means.

4. A governor for an internal combustion engine having a fuel pump comprising:

engine rotational speed detecting means for detecting a rotational speed of an engine and producing an engine rotational speed signal indicative of the engine rotational speed;

a variation removing circuit receiving the engine rotational speed signal from said detecting means and having means for removing a periodical variation component corresponding to the variable rotational speed of the engine from the engine rotational speed signal and producing an averaged rotational speed signal, said variation removing circuit including:

a sample-and-hold circuit for sampling and holding the engine rotational speed signal from said engine rotational speed detecting means;

a synchronizing signal generator for generating a timing signal to control the operation of said sample-and-hold circuit on the basis of the engine rotational speed signal from said engine rotational speed;

said synchronizing signal generator including:

first counter means for counting the engine rotational speed signal from said engine rotational speed detecting means and producing an output signal at a predetermined count;

timer means responsive to the output signal from said first counter means to produce a gate signal of a constant pulse width; and said sample-and-hold circuit including:

gate means responsive to the gate signal from said timer means to allow the engine rotational speed signal from said engine rotational speed detecting means to selectively pass therethrough;

second counter means for counting the engine rotational speed signal passed through said gate means;

register means for holding the count of said second counter means;

control means responsive to the gate signal from said timer means to control the operation of said second counter means and said register means;

engine rotational speed presetting means for generating an engine rotating speed setting signal indicative of a desired engine rotational speed; and means for calculating an amount of injected fuel to be supplied to the engine of the basis of the averaged rotational speed signal and the speed setting signal from said variation removing circuit and said engine rotational speed presetting means, respectively, and for suppling a fuel signal indicative of the calculated amount of injected fuel to the fuel injection pump for the engine.

5. A governor for an internal combustion engine having a fuel pump comprising:

engine rotational speed detecting means for detecting a rotational speed of an engine and producing an engine rotational speed signal indicative of the engine rotational speed;

a variation removing circuit receiving the engine rotational speed signal from said detecting means and having means for removing a periodical variation component corresponding to the variable rotational speed of the engine from the engine rotational speed signal prior to producing an averaged rotational speed signal, said variation removing circuit including:

variable characteristic filter means for suppressing a band of frequencies corresponding to the rotational speed of the engine, the frequency band being changed with the change of the engine rotational speed;

engine rotational speed presetting means for generating an engine rotating speed setting signal indicative of a desired engine rotational speed; and means for calculating an amount of injected fuel to be supplied to the engine on the basis of the averaged rotational speed signal and speed setting signal from said variation removing circuit and said engine rotational speed presetting means, respectively, and for supplying a fuel signal indicative of the calculated amount of injected fuel to the fuel injection pump for the engine.

6. A governor according to claim 5 wherein said variable characteristic filter means is connected to said engine rotational speed presetting means and suppresses a band of frequencies which is changed in accordance with the engine rotational-speed set signal from said engine rotational speed presetting means.

7. A governor according to claim 5 wherein said variable characteristic filter is connected to said engine rotational speed detecting means and the frequency band which said characteristic filter suppresses is changed in accordance with the engine rotational speed signal from said engine rotational speed detecting means.

8. A governor according to claim 4 wherein said fuel signal calculating and supplying means includes:

subtracting means for calculating the difference between the engine rotational speed setting signal from said engine rotational speed presetting means and the averaged signal from said variation removing circuit; and control calculation means for calculating an amount of injected fuel to be supplied to the engine based on the difference ouput from said subtracting means, and supplying the fuel signal to the fuel injection pump.

9. A governor according to claim 8 wherein said fuel signal supplying means includes function generator means between said subtracting means and said control calculation means and supplied with the difference output from said subtracting means, so that only when said difference output is small a gain of said function generator means is low for said difference output.

10. A governor according to claim 4 wherein said engine is a diesel engine.

* * * * *